US010676938B2

(12) United States Patent
Winter

(10) Patent No.: US 10,676,938 B2
(45) Date of Patent: Jun. 9, 2020

(54) TREAD SURFACE FOR DECKING SYSTEM

(71) Applicant: Homecare Products, Inc., Algona, WA (US)

(72) Inventor: Ronald S. Winter, Pacific, WA (US)

(73) Assignee: Homecare Products, Inc., Algona, WA (US)

( * ) Notice: Subject to any disclaimer, the term of this patent is extended or adjusted under 35 U.S.C. 154(b) by 0 days.

(21) Appl. No.: 16/405,363

(22) Filed: May 7, 2019

(65) Prior Publication Data

US 2019/0338530 A1 Nov. 7, 2019

Related U.S. Application Data

(60) Provisional application No. 62/725,847, filed on Aug. 31, 2018, provisional application No. 62/667,999, filed on May 7, 2018.

(51) Int. Cl.

| | |
|---|---|
| ***E04F 11/17*** | (2006.01) |
| ***E04F 11/00*** | (2006.01) |
| ***E04F 11/112*** | (2006.01) |
| ***E04F 11/18*** | (2006.01) |

(52) U.S. Cl.

CPC ..... *E04F 11/17* (2013.01); *E04F 11/002* (2013.01); *E04F 11/112* (2013.01); *E04F 11/18* (2013.01); *E04F 2011/007* (2013.01)

(58) Field of Classification Search

CPC ... E04F 11/002; E04F 11/02; E04F 2011/007; E04F 11/17; E04F 11/112; E04F 11/18

See application file for complete search history.

(56) References Cited

U.S. PATENT DOCUMENTS

| | | | | | |
|---|---|---|---|---|---|
| 442,256 | A * | 12/1890 | Nash | E04F 11/17 | 52/179 |
| 3,555,762 | A * | 1/1971 | Costanzo | E04C 2/08 | 52/588.1 |
| 3,742,911 | A * | 7/1973 | Lehe | A01K 1/0151 | 119/529 |
| 5,347,672 | A * | 9/1994 | Everard | A61G 3/061 | 14/69.5 |
| 5,446,937 | A * | 9/1995 | Haskins | B65G 69/287 | 14/69.5 |
| 5,881,508 | A * | 3/1999 | Irvine | E01C 5/20 | 405/219 |
| 5,903,943 | A * | 5/1999 | Sherrod | B65G 69/287 | 14/2.4 |
| 5,904,011 | A * | 5/1999 | Biro | B63B 5/06 | 52/177 |
| 6,082,061 | A * | 7/2000 | Ryan | B29C 45/14 | 52/182 |
| 6,199,340 | B1 * | 3/2001 | Davis | C08L 23/10 | 52/100 |
| 6,705,797 | B1 * | 3/2004 | Wada | E01C 5/00 | 404/38 |
| 6,895,622 | B2 * | 5/2005 | Szekely | E01C 11/24 | 14/69.5 |

(Continued)

*Primary Examiner* — Abigail A Risic

(74) *Attorney, Agent, or Firm* — Polsinelli PC

(57) ABSTRACT

A ramp and/or platform assembly includes a decking system having a tread surface on at least a portion of a top deck surface of the decking system, wherein the tread surface includes a plurality of multi-tiered ridges on the top deck surface for contact with a traveling body on the top deck surface.

15 Claims, 5 Drawing Sheets

(56) References Cited

U.S. PATENT DOCUMENTS

| | | | | |
|---|---|---|---|---|
| 7,021,012 | B2 * | 4/2006 | Zeng | E04F 15/02161 404/35 |
| 7,950,094 | B2 * | 5/2011 | Bailie | B65G 69/30 14/69.5 |
| 8,191,193 | B2 * | 6/2012 | Bailie | B65G 69/30 14/69.5 |
| 8,479,337 | B1 * | 7/2013 | Morris | A61G 3/061 14/69.5 |
| 8,844,083 | B2 * | 9/2014 | McGivern | E04F 11/002 14/69.5 |
| 2007/0258765 | A1 * | 11/2007 | Coyle | E01C 5/20 404/19 |
| 2008/0201874 | A1 * | 8/2008 | Coyle | E01C 5/20 14/71.1 |
| 2013/0055511 | A1 * | 3/2013 | McGivern | E04F 11/002 14/69.5 |
| 2013/0198978 | A1 * | 8/2013 | Pohlman | E01D 1/00 14/69.5 |

* cited by examiner

TREAD SURFACE FOR DECKING SYSTEM

CROSS-REFERENCES TO RELATED APPLICATIONS

The present application claims the benefit of U.S. Provisional No. 62/725,847, filed Aug. 31, 2018 and U.S. Provisional No. 62/667,999, filed May 7, 2018, the disclosures of which are hereby expressly incorporated by reference herein in their entirety.

BACKGROUND

Ramps and platforms are becoming increasingly common, due primarily to the recent passage of the Americans with Disabilities Act (ADA) requiring public buildings to be designed or modified to provide wheelchair access. These ramps and platforms assist those people confined to wheelchairs or who use walkers by providing a suitable pathway or ramp-way to the entrances of public and private buildings and stores, which may be at elevations above or below ground level.

Because each site may be generally different from other sites, some ramp and platform assemblies are modular in construction, and designed to minimize the cost and assembly time of on-site assembly. Ramp and platform assemblies generally include deck surfaces, support posts, and handrails. These modular assemblies can be configured to provide ramping and horizontal deck surfaces to provide access, for example, if a user needs to travel from elevation A to elevation B, but is not able to traverse stairs or a steep slope to get there.

Some ramp assemblies are portable and can be transported for use at various sites as decking surfaces, for example, if a user needs to travel from elevation A to elevation B, but is not able to traverse stairs.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, a ramp and/or platform assembly is provided. The assembly includes a decking system having a tread surface on at least a portion of a top deck surface of the decking system, wherein the tread surface includes a plurality of multi-tiered ridges on the top deck surface for contact with a traveling body on the top deck surface.

In accordance with another embodiment of the present disclosure, a method of manufacturing a ramp and/or platform of the ramp and/or platform assembly is provided. The assembly includes a decking system having a tread surface on at least a portion of a top deck surface of the decking system, wherein the tread surface includes a plurality of multi-tiered ridges on the top deck surface for contact with a traveling body on the top deck surface. The method includes extruding one or more portions of the decking system in an aluminum extrusion process.

In accordance with another embodiment of the present disclosure, a tread surface for a deck is provided. The tread surface includes: a plurality of multi-tiered ridges configured for contact with a traveling body; and spacing between adjacent multi-tiered ridges of the plurality of multi-tiered ridges.

In accordance with any of the embodiments described herein, the ramp and/or platform assembly may further include a support system for supporting the ramp and/or platform assembly.

In accordance with any of the embodiments described herein, the ramp and/or platform assembly may further include a handrail system coupled to the decking system and/or the support system.

In accordance with any of the embodiments described herein, the plurality of multi-tiered ridges may be oriented on the top deck surface to be substantially normal to the travel direction of the traveling body on the top deck surface.

In accordance with any of the embodiments described herein, the tread surface may include spacing between adjacent multi-tiered ridges of the plurality of multi-tiered ridges.

In accordance with any of the embodiments described herein, the multi-tiered ridges may include multiple edges for contact with the traveling body.

In accordance with any of the embodiments described herein, the multi-tiered ridges may include at least three edges for contact with the traveling body.

In accordance with any of the embodiments described herein, each of the plurality of multi-tiered ridges may include a first tier defining first and second lower edges and a second tier defining a top edge.

In accordance with any of the embodiments described herein, the tread surface may further include a plurality of voids along the length of one or more multi-tiered ridges.

In accordance with any of the embodiments described herein, the tread surface may further include a plurality of voids along the length of one or more multi-tiered ridges, wherein the plurality of voids extend to a depth extending from the second tier to below the first tier.

In accordance with any of the embodiments described herein, each multi-tiered ridge of the plurality of multi-tiered ridges may include a first rise to the first edge and a second rise to the top edge.

In accordance with any of the embodiments described herein, each multi-tiered ridge of the plurality of multi-tiered ridges may include a third rise to the second edge and a fourth rise to the top edge.

In accordance with any of the embodiments described herein, each multi-tiered ridge of the plurality of multi-tiered ridges may have an increased surface area configured for contact with a traveling body on the top deck surface compared to a single-tiered ridge.

In accordance with any of the embodiments described herein, a method of manufacture may further include knurling at least a portion of the decking system after the aluminum extrusion process.

DESCRIPTION OF THE DRAWINGS

The foregoing aspects and many of the attendant advantages of this disclosure will become more readily appreciated as the same become better understood by reference to the following detailed description, when taken in conjunction with the accompanying drawings, wherein.

DETAILED DESCRIPTION

Embodiments of the present disclosure are directed to tread surfaces for ramps and/or platform assemblies for improved traction and reduced slippage as a user is traversing a ramp and/or a platform. Embodiments of the present disclosure are also directed to ramps and/or platform assemblies or decks having tread surfaces and method of manufacturing decks with such tread surfaces.

The detailed description set forth below in connection with the appended drawings where like numerals reference like elements is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

The following description sets forth one or more examples of a ramp and/or platform assembly and components thereof. Generally, embodiments described herein relate to modular ramp and platform assemblies that may include deck surfaces, support posts, and handrails.

As described in greater detail below, many of the components of the ramp and/or platform assembly may be formed from metal, for example, from extruded aluminum. Extruded aluminum construction generally reduces parts in the overall system, thereby reducing manufacturing and assembly costs, as well as operational noise generated by rattling part couplings. Moreover, extruded aluminum parts can be designed to achieve the same strength and stiffness requirements as steel construction, while having reduced weight over steel parts or parts made from other materials, allowing for improved ease of assembly and optimized part design.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. It will be appreciated that embodiments of the present disclosure may employ any combination of features described herein.

Figure 1:
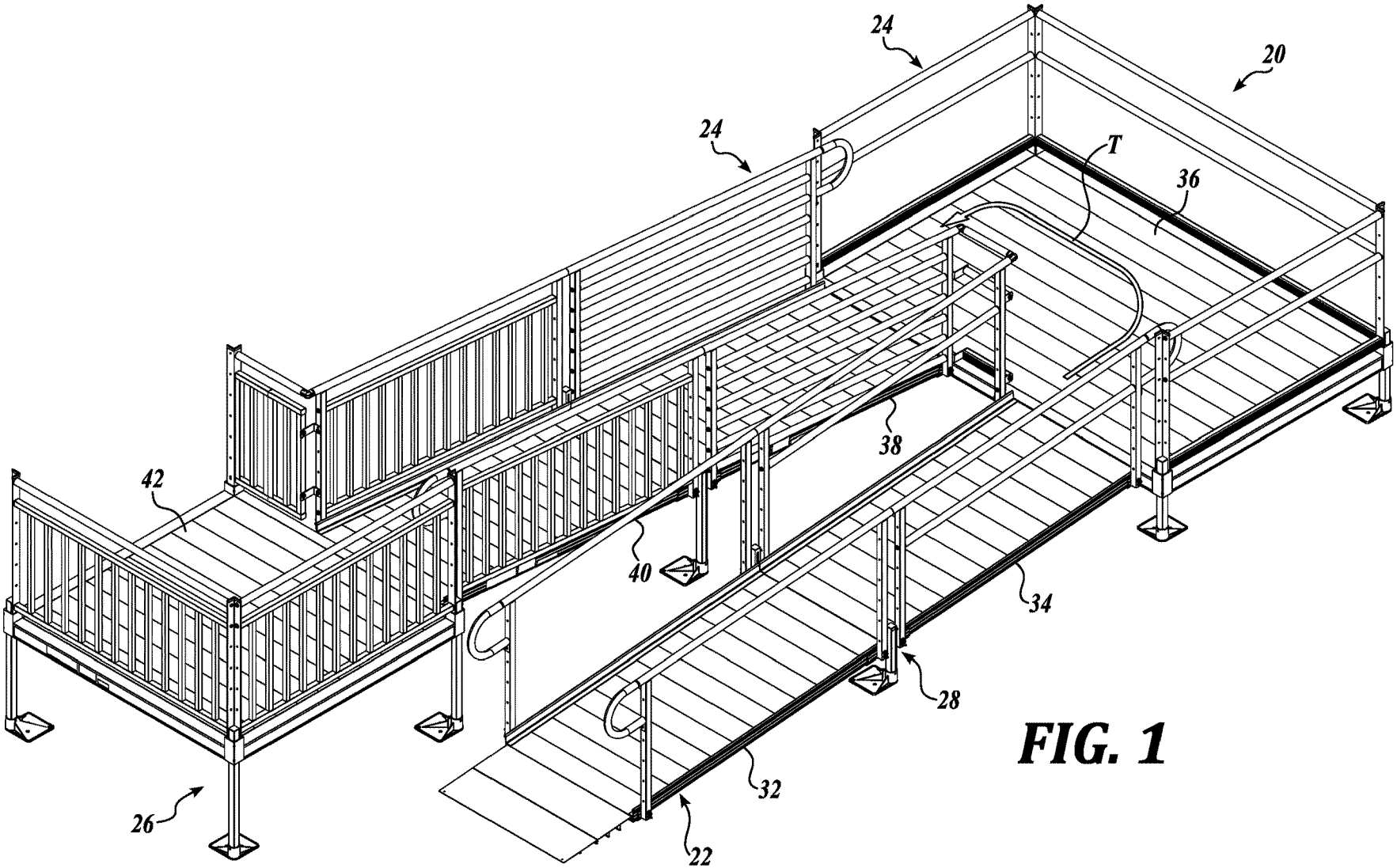
FIG. 1 is an isometric view of a ramp and platform assembly having tread surfaces in accordance with embodiments of the present disclosure.

FIG. 1 illustrates an example of a ramp and platform assembly, generally designated 20, formed in accordance with aspects of the present disclosure. In the embodiment shown in FIG. 1, the ramp and platform assembly 20 includes a decking system 22, a handrail system 24 configured to couple with the decking system 22, a support system 26 configured to couple with the decking system 22 and provide support to the decking system 22, and an interface 28 between the handrail system 24, the support system 26, and the decking system 22.

As a non-limiting example, the ramp and platform assembly 20 of FIG. 1 includes a platform section 36 at a certain elevation, and ramping sections 32 and 34 extending from a ground surface to a the elevation of the platform section 36. Other configurations of ramp and/or platform assemblies, whether for residential or commercial applications, are also within the scope of the present disclosure.

In accordance with ADA requirements, the grade of the ramp must be within a certain rise to run ratio (for example less than 1:12). Such ratio may vary for ramping deck surfaces depending on the rise and the distance between the desired high and low elevation points of the ramp.

The decking system 22 of the ramp and/and platform assembly 20 may be configured from one or more decks. In the illustrated embodiment, the decking system 22 includes ramping decks 32 and 34 and platform decks 36, 38, 40, and 42. Other decking systems including any number of decks are within the scope of the present disclosure.

In accordance with embodiments of the present disclosure, one or more of the ramping decks 32 and 34 and the platform decks 36, 38, 40, and 42 include a tread surface 50 on a top deck surface of at least a portion of one or more of the decks of the decking system 22. Because ramp and/or platform assemblies in accordance with embodiments of the present disclosure provide decking surfaces upon which a user or a traveling body (such as a person walking or a wheelchair, bicycle, or scooter traveling) must traverse, the tread surface 50 of the decking system 22 may be designed and configured to improve traction and reduce slippage for the traveling body.

Figures 2A, 2B:
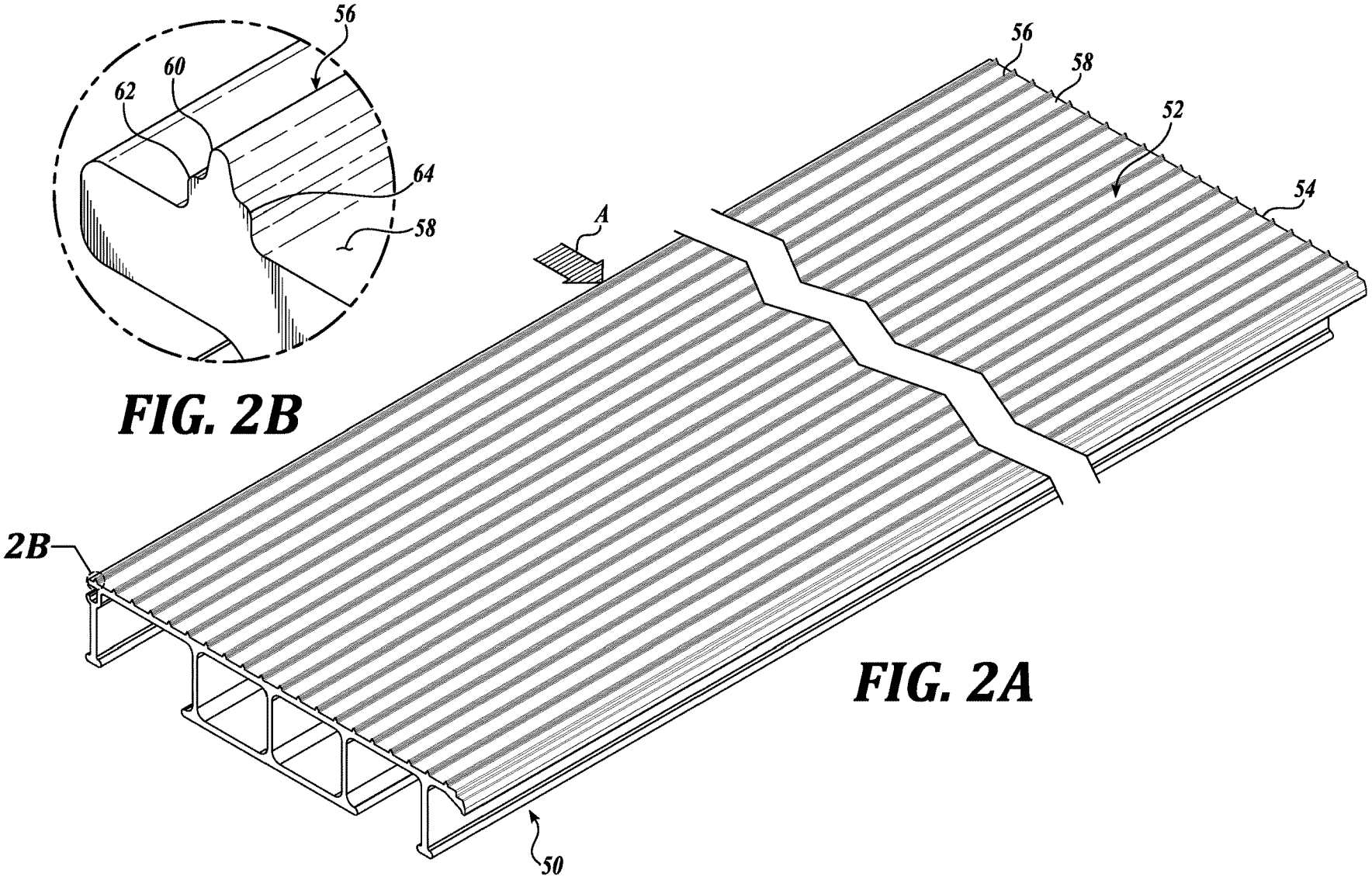
FIGS. 2A and 2B are isometric views of a deck and a tread surface (in close-up) in accordance with embodiments of the present disclosure.

Referring to FIGS. 2A/2B and 3A/3B, a deck 50 in the decking system 22 having a tread surface 52 in accordance with embodiments of the present disclosure will be described. As seen in FIGS. 2A and 3A, the tread surface 52 covers the top deck surface 54 of the decking 50. The tread surface 52 includes a plurality of multi-tiered ridges 56 on the top deck surface 54 of the deck 50 for contact with a traveling body (such as a person walking, a wheelchair, a bicycle, or a scooter) on the top deck surface 54. The tread surface 52 further includes spacing 58 between adjacent multi-tiered ridges 56 on the top deck surface 54.

Figure 4:
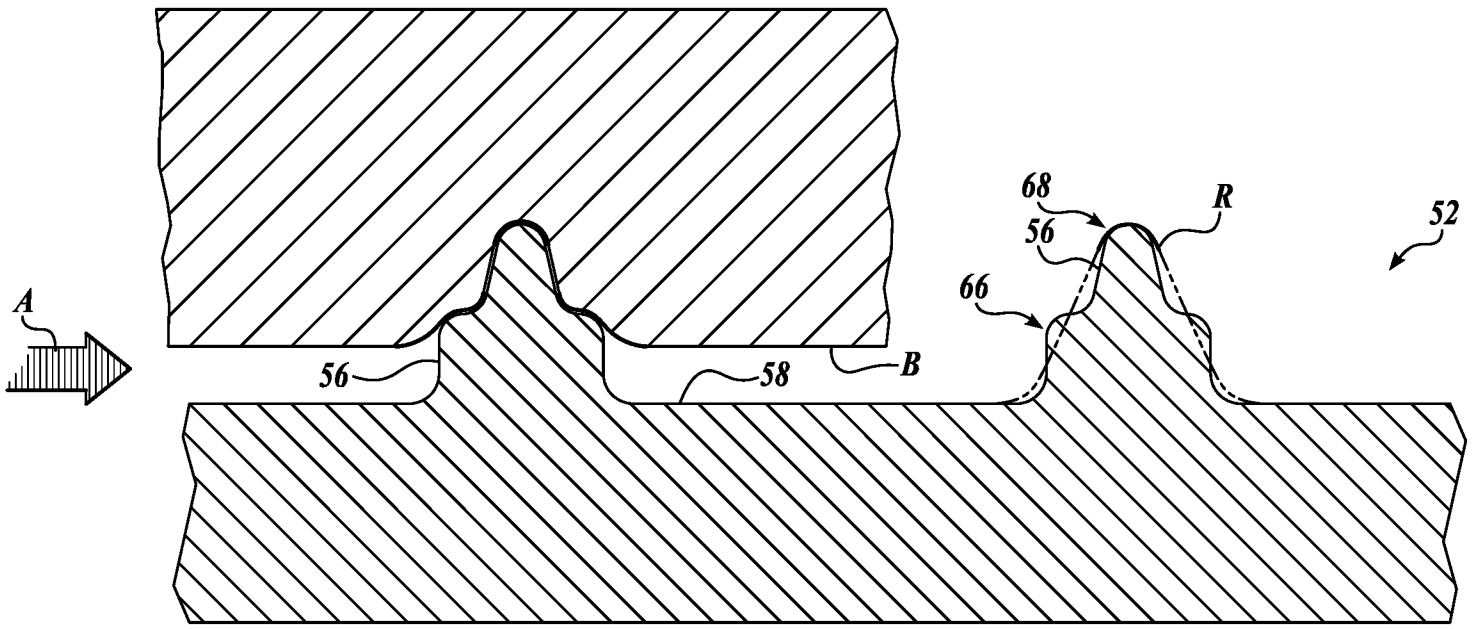
FIG. 4 is a side view of a tread surface in close up comparing a tread in accordance with embodiments of the present disclosure with a previously designed tread shape.

Referring now to FIG. 4, the multi-tiered ridges 56 are generally sized to have the same or substantially the same height as previously developed single-tiered ridges. The spacing 58 between the multi-tiered ridges 56 is generally sized to be the same or substantially the same spacing as between previously developed single-tiered ridges. Ridge height and spacing is determined to provide a friction surface without providing a tripping hazard.

In the illustrated embodiment of FIGS. 2A and 3A, the plurality of multi-tiered ridges 56 are oriented on the top deck surface 54 to be substantially normal to the travel direction (shown as arrow A in FIG. 2A) of the traveling body on the top deck surface 54. However, in other embodiments, the plurality of multi-tiered ridges 56 may be oriented to be parallel to the travel direction A or at an angle relative to the travel direction A.

Figure 3B:
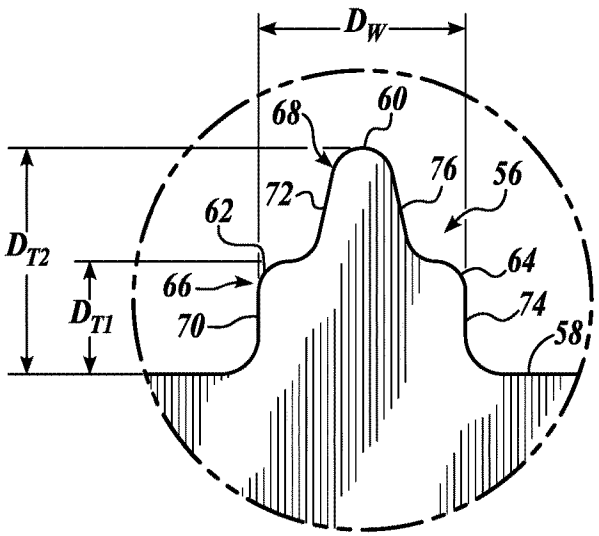
FIGS. 3A and 3B are side views of the deck and tread surface (in close-up) of FIGS. 2A and 2B in accordance with embodiments of the present disclosure.
Figure 3A:
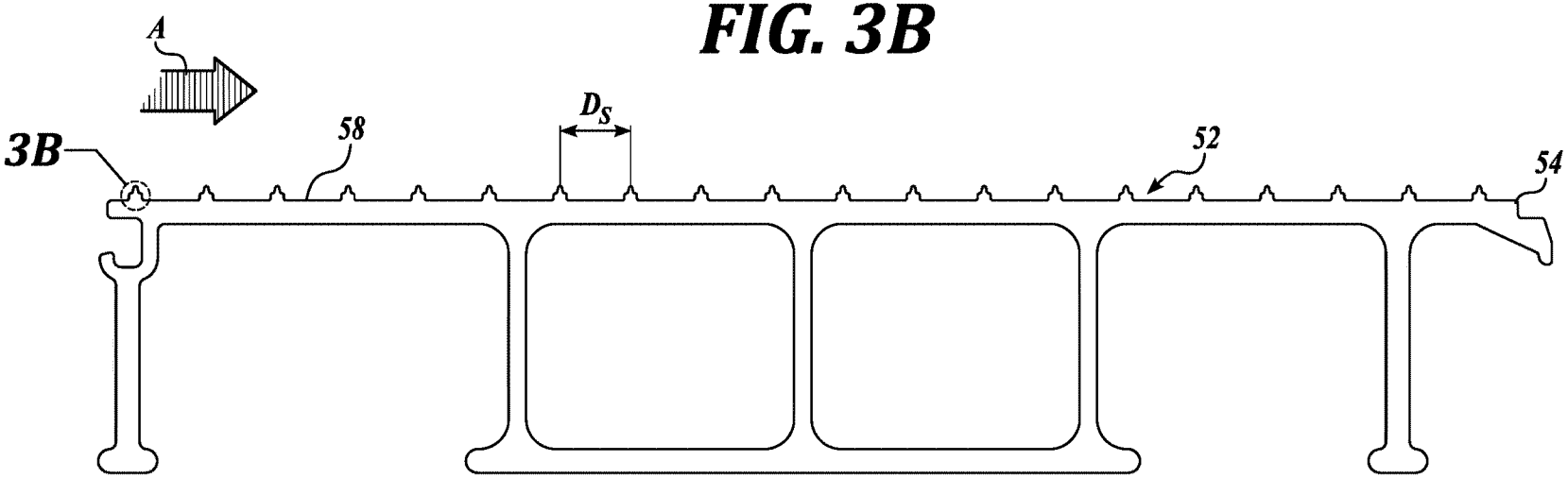

Referring to the close-up views of FIGS. 2B and 3B, the multi-tiered ridges 56 include multiple edges for contact with the traveling body. For example, in the illustrated embodiment of FIGS. 2B and 3B, the multi-tiered ridges 56 include at least three edges 60, 62, 64 for contact with the traveling body. In the illustrated embodiment, each edge 60, 62, 64 extends across the width of the deck 50 substantially normal to the travel direction (shown as arrow A) of the traveling body on the top deck surface 54.

In the illustrated embodiment, each of the plurality of multi-tiered ridges 56 includes a first tier 66 defining first and second lower edges 62 and 64 and a second tier 68 defining a top edge 60. The edges 60, 62, and 64 define three potential lines of contact with a traveling body on the tread surface 52. As seen in FIG. 3B, each ridge 56 includes a first rise 70 to the first edge 62 and a second rise 74 to the top edge 60. Each ridge 56 may further include a third rise 76 to the second edge 64 and a fourth rise 78 to the top edge 60.

The multi-tiered ridges 56 and the spacing 58 therebetween may be designed and configured for improved traction for a traveling body, but not so as to creating a tripping hazard. In some embodiments of the present disclosure, the spacing dimension ($D_S$) may be 0.30 inches +/−10%. In some embodiments of the present disclosure, the spacing dimension ($D_S$) may be 0.30 inches +/−20%. In some embodiments of the present disclosure, the spacing dimension ($D_S$) may be 0.30 inches +/−30%.

In some embodiments, the heights ($D_{T1}$ and $D_{T2}$) of the first and second tiers 66 and 68 may be, respectively, 0.030 inches +/−10% and 0.060 inches +/−10%. In some embodiments, the heights ($D_{T1}$ and $D_{T2}$) of the first and second tiers 66 and 68 may be, respectively, 0.030 inches +/−10% and 0.060 inches +/−20%. In some embodiments, the heights ($D_{T1}$ and $D_{T2}$) of the first and second tiers 66 and 68 may be, respectively, 0.030 inches +/−10% and 0.060 inches +/−30%.

In some embodiments, the width ($D_W$) of each multi-tiered ridge 56 from the base of the first rise 70 to the base of the third rise 76 may be 0.055 inches +/−10%. In some embodiments, the width ($D_W$) of each multi-tiered ridge 56 from the base of the first rise 70 to the base of the third rise 76 may be 0.055 inches +/−20%. In some embodiments, the width ($D_W$) of each multi-tiered ridge 56 from the base of the first rise 70 to the base of the third rise 76 may be 0.055 inches +/−30%.

One advantageous effect of tread surface 52 in accordance with embodiments of the present disclosure is that a multi-tiered ridge has an increased surface area over a single-tiered ridge. For example, as can be seen in FIG. 4, the surface area of the multi-tiered ridge 56 is increased over the surface area of the single-tiered ridge R (shown in phantom). With increased surface area, the multi-tiered ridges 56 provide a higher coefficient of friction (COF) to prevent slippage. As seen in FIG. 4, exemplary contact between a traveling body B (such as a wheelchair wheel or the sole of are shoe) and a multi-tiered ridge 56 are shown.

In accordance with embodiments of the present disclosure, COF increases at least 2% for tread surfaces having multi-tiered ridges, as compared to tread surfaces having non-tiered ridges of the same dimensions and spacing and in the same environment conditions. In accordance with other embodiments of the present disclosure, COF increases at least 5% for tread surfaces having multi-tiered ridges, as compared to tread surfaces having non-tiered ridges of the same dimensions and spacing and in the same environment conditions. In accordance with other embodiments of the present disclosure, COF increases at least 10% for tread surfaces having multi-tiered ridges, as compared to tread surfaces having non-tiered ridges of the same dimensions and spacing and in the same environment conditions. In accordance with other embodiments of the present disclosure, COF increases at least 15% for tread surfaces having multi-tiered ridges, as compared to tread surfaces having non-tiered ridges of the same dimensions and spacing and in the same environment conditions.

Decks 50 designed and configured with tread surfaces 52 in accordance with embodiments of the present disclosure may be made from aluminum by aluminum extrusion processes. The tread surfaces 52 may be formed during the extrusion process.

After the deck 50 has been extruded to include a tread surface 52 in accordance with embodiments of the present disclosure, the tread surface 52 may be knurled to provide additional traction to the surface. For example, referring to FIG. 1, a wheel chair or a person traversing the modular ramp assembly 20 will make a turn on platform 36 as indicated by arrow T. During some of the travel distance, the traversing body will travel in a direction parallel to the multi-tiered ridges 56. In this direction, the ridges 56 will not provide a frictional surface to prevent slippage. Knurling, as seen in FIG. 4, in a direction normal to the direction of the ridges 56 provides a cross-directional frictional surface.

Figure 5:
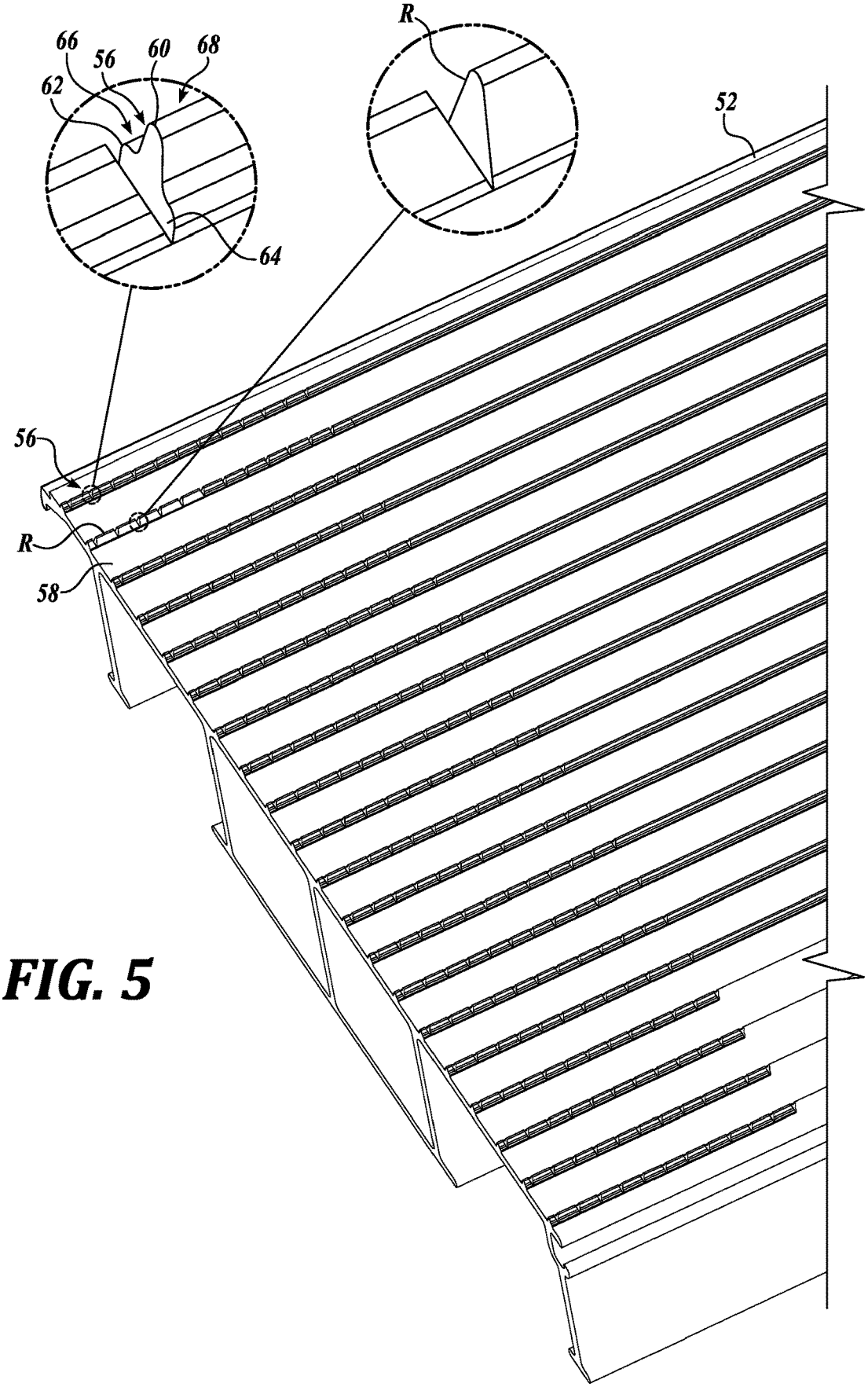
FIG. 5 is an isometric view of a tread surface comparing a tread in accordance with embodiments of the present disclosure with a previously designed tread.

The knurling may be performed as press knurling immediately following the extrusion process to press in the knurling or as secondary knurling after the extrusion process to remove material to achieve knurling. Knurling of multi-tiered ridges 56 as shown in FIG. 5 can be achieved using either press knurling or secondary knurling processes.

In accordance with embodiments of the present disclosure, the voids 80 achieved by knurling extend into the ridge 56 along the length of the ridge 56. In the illustrated embodiment, the voids 80 extend through the ridge 56 from the second tier 68 to a depth below the first tier 66. As seen in the illustrated embodiment of FIG. 5, knurling to a depth below the first tier 66 of the ridge 56 provides an elongated edge and contoured 82 along the void 80 for increased contact area and increased traction between the traversing body B and the edge 82.

In accordance with embodiments of the present disclosure, COF increases at least 2% for tread surfaces having multi-tiered ridges and cross-directional knurling, as compared to tread surfaces having non-tiered ridges of the same dimensions and spacing and no knurling and in the same environment conditions. In accordance with embodiments of the present disclosure, COF increases at least 5% for tread surfaces having multi-tiered ridges and cross-directional knurling, as compared to tread surfaces having non-tiered ridges of the same dimensions and spacing and no knurling and in the same environment conditions. In accordance with other embodiments of the present disclosure, COF increases at least 10% for tread surfaces having multi-tiered ridges, as compared to tread surfaces having non-tiered ridges of the same dimensions and spacing and in the same environment conditions. In accordance with embodiments of the present disclosure, COF increases at least 15% for tread surfaces having multi-tiered ridges and cross-directional knurling, as compared to tread surfaces having non-tiered ridges of the same dimensions and spacing and no knurling and in the same environment conditions.

In some embodiments of the present disclosure, the multi-tiered ridges only require a single step of knurling instead of two second steps of knurling as generally used for previously developed single-tiered ridges, therefore reducing a step in manufacturing the deck 50.

EXAMPLE

COF Improvements for Multi-tiered Ridges at 1:12 Slope

A decking surface having a tread surface at an incline of 5-degrees including multi-tiered ridges having a ridge height of 0.075 to 0.090 inches, and a spacing between ridges of 0.3 inches will have increased coefficient of friction (COF) of 4% to 7% in dry conditions and 2.8% to 5.1% in wet conditions, as compared to a decking surface having a standard tread surface having standard ridges having similar height and spacing between ridges of 0.3 inches.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

While illustrative embodiments have been illustrated and described, it will be appreciated that various changes can be made therein without departing from the spirit and scope of the present disclosure.

The embodiments of the invention in which an exclusive property or privilege is claimed are defined as follows:

1. A ramp and/or platform assembly, comprising:

a decking system having a tread surface on at least a portion of a top deck surface of the decking system, wherein the tread surface includes a plurality of multi-tiered ridges on the top deck surface for contact with a traveling body on the top deck surface, wherein each of the plurality of multi-tiered ridges has a single top edge at a first height extending from the top deck surface, and wherein each of the plurality of multi-tiered ridges includes a first tier defining first and second first tier edges at a second height in between the top deck surface and the first height of the single top edge, and a second tier defining the single top edge, such that each of the plurality of multi-tiered ridges has at least three edges for contact with the traveling body.

2. The ramp and/or platform assembly of claim 1, further comprising a support system for supporting the ramp and/or platform assembly.

3. The ramp and/or platform assembly of claim 2, further comprising a handrail system coupled to the decking system and/or the support system for supporting the ramp and/or platform assembly.

4. The ramp and/or platform assembly of claim 1, wherein the plurality of multi-tiered ridges are oriented on the top deck surface to be substantially normal to the travel direction of the traveling body on the top deck surface.

5. The ramp and/or platform assembly of claim 1, wherein the tread surface includes spacing between adjacent multi-tiered ridges of the plurality of multi-tiered ridges.

6. The ramp and/or platform assembly of claim 1, further comprising a plurality of voids along the length of one or more multi-tiered ridges.

7. The ramp and/or platform assembly of claim 1, further comprising a plurality of voids along the length of one or more multi-tiered ridges, wherein the plurality of voids extend to a depth extending from the second tier to below the first tier.

8. The ramp and/or platform assembly of claim 1, wherein each multi-tiered ridge of the plurality of multi-tiered ridges includes a first rise to the first edge and a second rise to the top edge.

9. The ramp and/or platform assembly of claim 6, wherein each multi-tiered ridge of the plurality of multi-tiered ridges includes a third rise to the second edge and a fourth rise to the top edge.

10. The ramp and/or platform assembly of claim 1, wherein each multi-tiered ridge of the plurality of multi-tiered ridges have an increased surface area configured for contact with a traveling body on the top deck surface compared to a single-tiered ridge.

11. A method of manufacturing a ramp and/or platform of the ramp and/or platform assembly of claim 1, comprising extruding one or more portions of the decking system in an aluminum extrusion process.

12. A method of manufacturing a ramp and/or platform of the ramp and/or platform assembly of claim 11, further comprising knurling at least a portion of the decking system after the aluminum extrusion process.

13. A tread surface for a deck, the tread surface comprising:

a plurality of multi-tiered ridges configured for contact with a traveling body, wherein each of the plurality of multi-tiered ridges has a single top edge at a first height extending from the top deck surface, and wherein each of the plurality of multi-tiered ridges includes a first tier defining first and second first tier edges at a second height in between the top deck surface and the first height of the single top edge, and a second tier defining the single top edge, such that each of the plurality of multi-tiered ridges has at least three edges for contact with the traveling body; and spacing between adjacent multi-tiered ridges of the plurality of multi-tiered ridges.

14. The tread surface of claim 13, wherein the plurality of multi-tiered ridges are oriented on a top deck surface to be substantially normal to the travel direction of the traveling body on the top deck surface.

15. A tread surface for a deck, the tread surface comprising:

a plurality of multi-tiered ridges configured for contact with a traveling body, wherein each of the plurality of multi-tiered ridges has a single top edge at a first height extending from the top deck surface, and wherein each of the plurality of multi-tiered ridges includes a first tier defining first and second first tier edges at a second height in between the top deck surface and the first height of the single top edge, and a second tier defining the single top edge, such that each of the plurality of multi-tiered ridges has at least three edges for contact with the traveling body; and spacing between adjacent multi-tiered ridges of the plurality of multi-tiered ridges.

* * * * *